US005954780A

United States Patent [19]

Jang

[11] Patent Number: 5,954,780

[45] Date of Patent: Sep. 21, 1999

[54] METHOD FOR GENERATING SPEED CONTROL CODE FOR TRAIN

[75] Inventor: Ki Dong Jang, Seoul, Rep. of Korea

[73] Assignee: LG Industrial Systems Co., Ltd., Seoul, Rep. of Korea

[21] Appl. No.: 08/695,964

[22] Filed: Aug. 13, 1996

[30] Foreign Application Priority Data

Aug. 21, 1995 [KR] Rep. of Korea ..... 95-25667

[51] Int. Cl.[6] ..... B61L 3/00

[52] U.S. Cl. ..... 701/93; 701/20

[58] Field of Search ..... 246/25, 182 B, 246/182 C, 182 R, 167 D, 122 R; 701/20, 300, 301, 93

[56] References Cited

U.S. PATENT DOCUMENTS 3,725,921 4/1973 Weidman et al. ..... 343/7 ED
5,388,789 2/1995 Rudershausen ..... 246/167 D

*Primary Examiner*—William A. Cuchlinski, Jr.
*Assistant Examiner*—Arthur D. Donnelly
*Attorney, Agent, or Firm*—Oliff & Berridge, PLC

[57] ABSTRACT

A method for generating a speed control code for a train which is capable of enhancing the operational efficiency of the train, maximizing the train line capacity, and enabling a stable running of the train by detecting the speed of a preceding train and the distance between the preceding train and the next succeeding train of the preceding train and by generating a speed indication code corresponding to the speed of the preceding train, which includes a first step for detecting a speed and a position of the preceding train and the next succeeding train; a second step for generating a speed indication code to each intervening track interval so that the next succeeding train can stop within a predetermined safety distance when the interval between the position of the preceding train detected in the first step and the position of the next succeeding train is within the previously set safety distance; and a third step for generating a speed indication code corresponding to the speed of the preceding train to the preceding train when the interval between the position of the preceding train detected in the first step and the position of the next succeeding train.

7 Claims, 4 Drawing Sheets

FIG. 2A
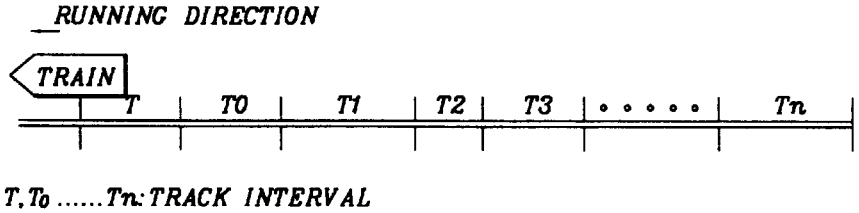
FIG. 2B
FIG. 2C
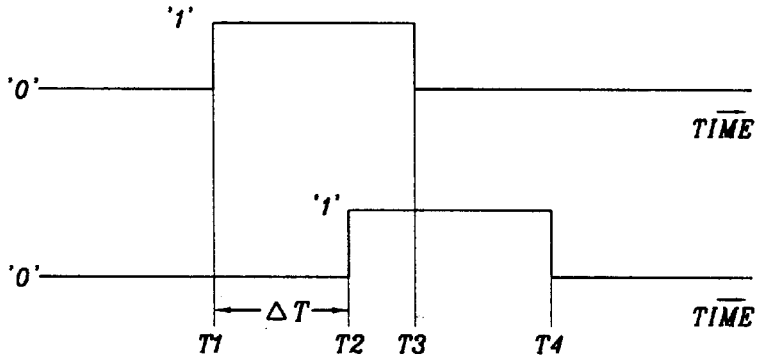
FIG. 3
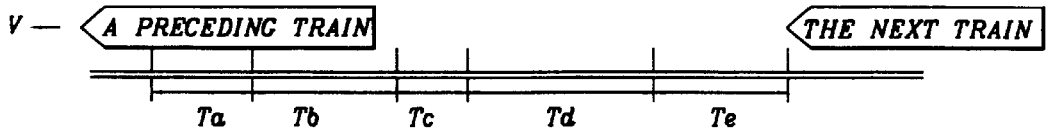

METHOD FOR GENERATING SPEED CONTROL CODE FOR TRAIN

BACKGROUND OF THE INVENTION

1. Field of the Invention

The present invention relates to a method for generating a speed control code for a train, and particularly to an improved method for generating a speed control code for a train which is capable of significantly increasing a train transportation capacity and efficiency by enabling a high speed train operation and by maintaining an optimized interval between a preceding train and the next succeeding train.

2. Description of the Conventional Art

Generally, it is very important to control the interval between a preceding train and the next succeeding train for enhancing a train transportation efficiency. In order to prevent a train collision, an off-line train accident, or the like, a traffic system is provided for enabling a high speed operation of the trains.

However, the speed control of the train is generally performed in cooperation with a traffic signal light. In this case, as the technology advances, and the train speed is made faster, there may occur an accident because the train driver still must visually monitor and check the traffic situation by using such signal lights.

In order to prevent the above-mentioned problems and to enhance the transportation efficiency of the train, a train stop apparatus, an automatic speed control apparatus, an automatic train running apparatus or the like is used. Theses apparatuses are directed to transmitting a speed indication code, which indicates the running speed of the next succeeding train and a preceding train based on the distance between the preceding train and the next succeeding train, to a traffic signal light device, so that the speed of the trains can be controlled according to the information from the traffic signal light device.

The conventional speed control signal generation principle for the train will now be explained in more detail with reference to FIG. 1.

A speed code generator 10 detects a preceding train which runs at a position "A", and applies a speed indication code such as an absolute stop code RR, a stop code R, speed limit codes R1 and R2, and the like to each of track intervals L1 through L4, which codes are obtained based on the distance between the preceding train and the next succeeding train which runs at a position "B". If the next succeeding train enters the track interval L2, the next succeeding train receives a speed indication code R which is applied to the track interval L2, and the succeeding train controls its speed based on the distance from the preceding train in accordance with the speed indication code R. In this case, the track interval L1 is a buffer zone for preventing any accident in case that the next succeeding train cannot stop at the track interval L2.

For example, on the assumption that the preceding train runs at the position "A" at a speed of 150 km/h, and the next succeeding train runs at a speed of 200 km/h, the next succeeding train can run at the maximum speed at the position "B" which is within the previous interval of the track interval L4. When the next succeeding train enters the track interval L4 in which the speed of the train is limited at 100 km/h, the train runs at 100 km/h. At this time, if the preceding train runs at a speed of 150 km/h, the distance between the preceding train and the next succeeding train is made longer, so that the next succeeding train can run at 200 km/h through the interval after the track interval L4.

However, in the conventional method, since the speed of the next succeeding train is controlled in accordance with the distance between the preceding train and the next succeeding train, the deceleration and acceleration of the train are repeated, causing inconvenience to passengers of the train. In addition, when the preceding train is accelerated, the distance is made longer from the next succeeding train, so it is impossible to secure a constant train running distance between the trains, and it is impossible to flexibly set the distance of the track interval, thus causing many problems with respect to the on-time operation of the trains.

SUMMARY OF THE INVENTION

Accordingly, it is an object of the present invention to provide a method for generating a speed control code for a train, which overcomes the problems encountered in the conventional method for generating a speed control code for a train.

It is another object of the present invention to provide an improved method for generating a speed control code for a train which is capable of enhancing the operational efficiency of the train, maximizing the train transportation capacity, and enabling a stable running of the train by detecting the speed of the preceding train and the distance between the preceding train and the next succeeding train and by generating a speed indication code corresponding to the speed of the preceding train.

To achieve the above objects, in accordance with a first embodiment of the present invention, there is provided a method for generating a speed control code for a train which includes a first step for detecting a speed and a position of a preceding train and of a next succeeding train; a second step for generating a speed indication code for each of plural intervening track intervals so that the next succeeding train can stop within a predetermined safety distance when an interval between the position of the preceding train detected in the first step and the position of the next succeeding train is within the previously set safety distance; and a third step for generating a speed indication code corresponding to the speed of the preceding train to the preceding train when the interval between the position of the preceding train detected in the first step and the position of the next succeeding train.

To achieve the above objects, in accordance with a second embodiment of the present invention, there is provided a method for generating a speed control code for a train which includes a first step for detecting a speed of a preceding interval and for generating a speed indication speed to a track interval in which the preceding train runs; a second step for generating a speed indication code of a stop signal to the current track interval which is next to the track interval within which the train runs and for setting a length of the current track interval as a track sum length; a third step for extending the track sum length when the track sum length is shorter than a safety distance and for setting a necessary distance so as to slow down the speed of the next succeeding train down to a speed corresponding to a predetermined speed indication code when the track sum length is longer than the previously set safety distance; and a fourth step for prolonging the length of the track sum when the track sum distance is shorter than the safety distance in the third step and for returning to the first step after applying a speed indication code corresponding to a maximum speed to the current track interval when the track sum distance is longer than the safety distance set in the third step.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 2A, 2B, and 2C show a detection method of train speed according to the present invention;

FIG. 3 shows a method thereby a speed code generator generates a speed indication code in accordance with the speed of a preceding train according to the present invention; and FIG. 4A

DETAILED DESCRIPTION OF THE INVENTION

Figure 1:
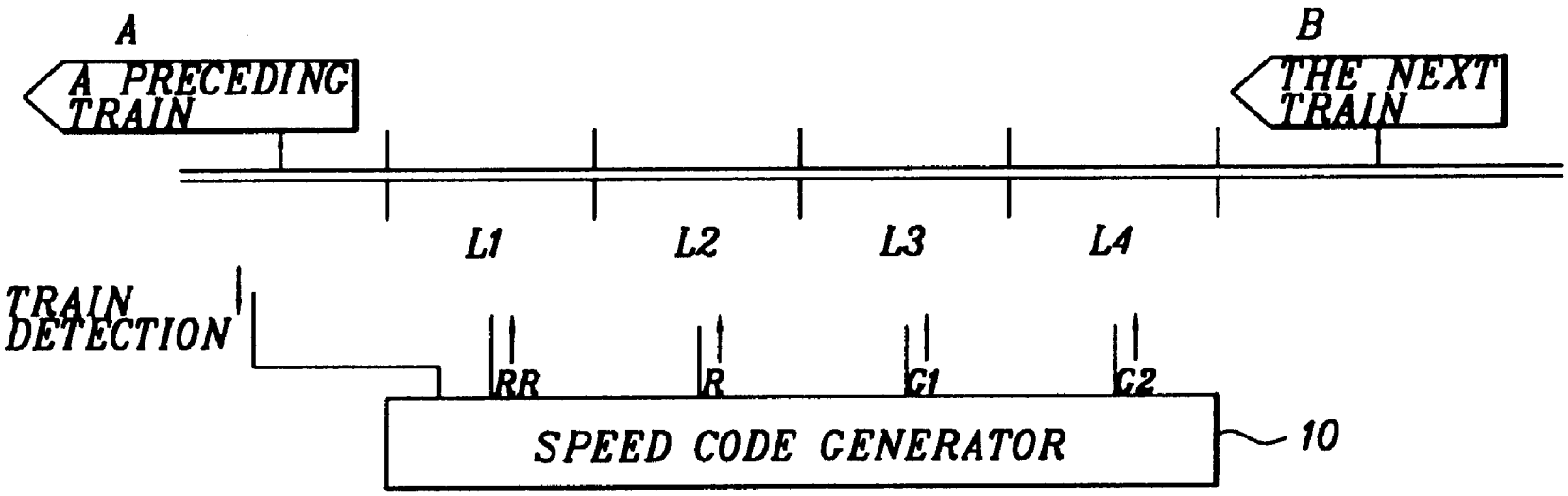
FIG. 1 CONVENTIONAL ART
FIG. 1 shows a conventional method for generating a speed control code in accordance with an interval between trains.

FIGS. 2A, 2B, and 2C show a detection method of a train speed according to the present invention. As shown in FIG. 2A, train detection apparatuses (not shown) disposed at each of track intervals T–Tn detect the moment when the head end of the train enters each of track intervals T–Tn and the moment when the tail end of the train passes through each of the track intervals T–Tn. The length data of each of the track intervals T–Tn is stored in a data base where n denotes 1, 2, 3, . . . , n, and the train detection apparatus may be implemented by a track circuit or other type of detection apparatus.

FIG. 2B is a wave form of a train detection signal which is generated by the train detection apparatus at the track interval T0. When the head end of the train enters the track interval T0 (at time t1), the level of the train detection signal becomes logical "1", and at the time when the tail end of the train passes through the track interval T0 (at time t3), the level of the train detection signal become logical "0".

FIG. 2C is a wave form of a train detection signal which is generated by the train detection apparatus at the track interval T. When the head end of the train enters the track interval T (at time t2), the level of the train detection signal becomes logical "1", and when the tail end of the train passes through the track interval T (at time t4), the level of the train detection signal becomes logical "0".

Therefore, the train is detected simultaneously at the track intervals T0 and T.

The time period At during which the head end of the train stayed within the track interval T0 is computed by "t2–t1", and the speed of the train at the track interval T is computed by "the track interval (t)/time period Δt".

The speed of the train computed by the speed code generator 10 is used for deciding the speed indication code with respect to the next succeeding train.

When the preceding train is stopped, namely, when the speed V of the preceding train is 0, the speed code generator 10 applies speed indication codes Rr, R, and (G1–Gn) to the track intervals Ta, Tb, . . . , Tn, respectively, based on the length of the previously stored track intervals Ta, Tb, . . . , Tn in order for the speed of the next succeeding train to become zero before the next succeeding train stops at a buffer zone.

Here, when the speed V of the preceding train is 0, the speed indication code RR reduces the speed of the next succeeding train in order for the next succeeding train to be stopped within the absolute stop interval. When the preceding train runs at the speed (V: V1>V>0), the speed indication code R defines the speed V1 as its limit speed of the next succeeding train, and when the preceding train runs at the speed (V: V2>V>V1), the speed indication code G1 defines the speed V2 as its limit speed. In the above manner, when the preceding train runs at the speed (V: Vn+1>V>Vn), the speed indication code Gn defines the speed Vn+1 as its limit speed.

Therefore, when the preceding train runs in the track interval in accordance with the speed indication code R, the speed of the next succeeding train is reduced in order to enable it to stop within the absolute stop interval. In a state that the preceding train runs in accordance with the speed indication code G1, and the buffer distance is substantially secured, the next succeeding train runs at the minimum speed corresponding to the speed indication code G1. Namely, if the speed of the preceding train is within the range of the speed indicating code G1 (namely, between the limit speed that the speed indication code G1 indicates and the limit speed that the speed indication code R indicates), the next succeeding train runs at the minimum speed in accordance with the speed indication code G1 before the next succeeding train enters the safety distance.

The preceding train runs in accordance with the speed indication code Gn, and in a state that the safety distance is secured, the next succeeding train runs at the minimum speed corresponding to the speed indication code Gn. Namely, the preceding train runs in accordance with the speed indication code Gn, and the next succeeding train runs in accordance with the speed indication code Gn before the next succeeding train reaches the safety distance.

If the preceding train, which is running in accordance with the speed indication code Gn, is abruptly stopped in accordance with the speed indication code RR, since the preceding train stops after passing through at least a few track intervals, when the next succeeding train has a substantial safety distance from the preceding train, the next succeeding train which runs in accordance with the speed indication code Gn can stop within the safety distance in accordance with an abrupt stop signal based on the speed indication code RR.

In consideration of the above points, the speed code generator 10 defines the safety distance and implements the speed synchronization between the preceding and next succeeding trains.

For example, if the set safety distance exceeds 1 km, and the speed of the train is 50 km/h in accordance with the speed indication code G1, and the speed of the train is 100 km in accordance with the speed indication code G2, and the preceding train which runs in accordance with the speed indication code G2 receives the speed indication code G1, the speed code generator 10 checks the length of the track interval Tc, to which the speed indication code of G1(50 km) is applied from the data base. Here, when the length is over 1 km, the speed indication code of G2(100 km) is applied to the track interval Td. However, when the length is shorter than 1 km, the speed code generator 10 applies the speed indication code of G1(50 km) with respect to the track interval Td. When the lengths of the track intervals Tc and Td are longer than 1 km, respectively, the speed indication code of Ge(100 km) is applied to the track intervals Tc and Td, respectively.

Figure 4A:
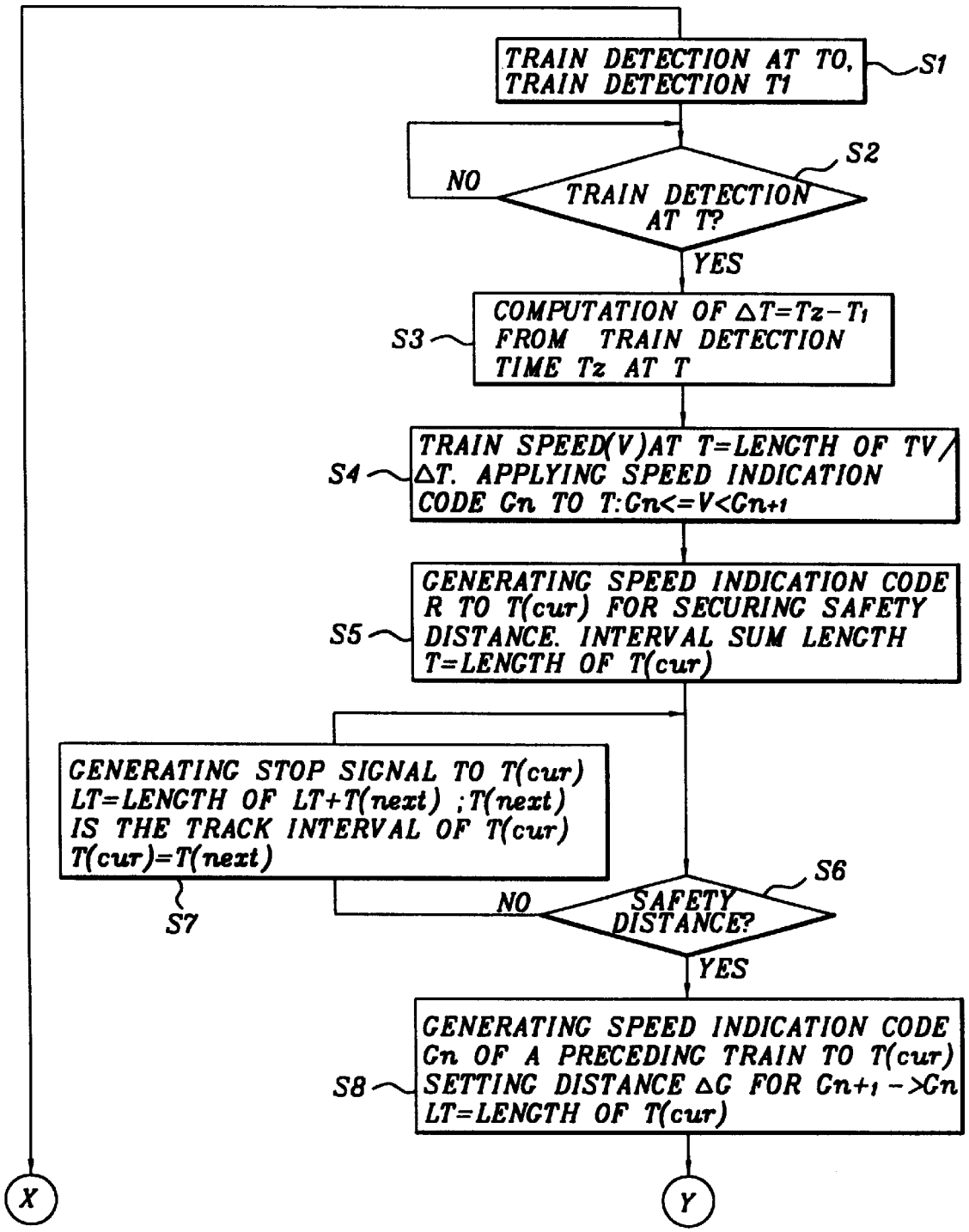
FIG. 4B is a flow chart of the speed indication code generation method of FIG. 3 according to the present invention.
Figure 4B:
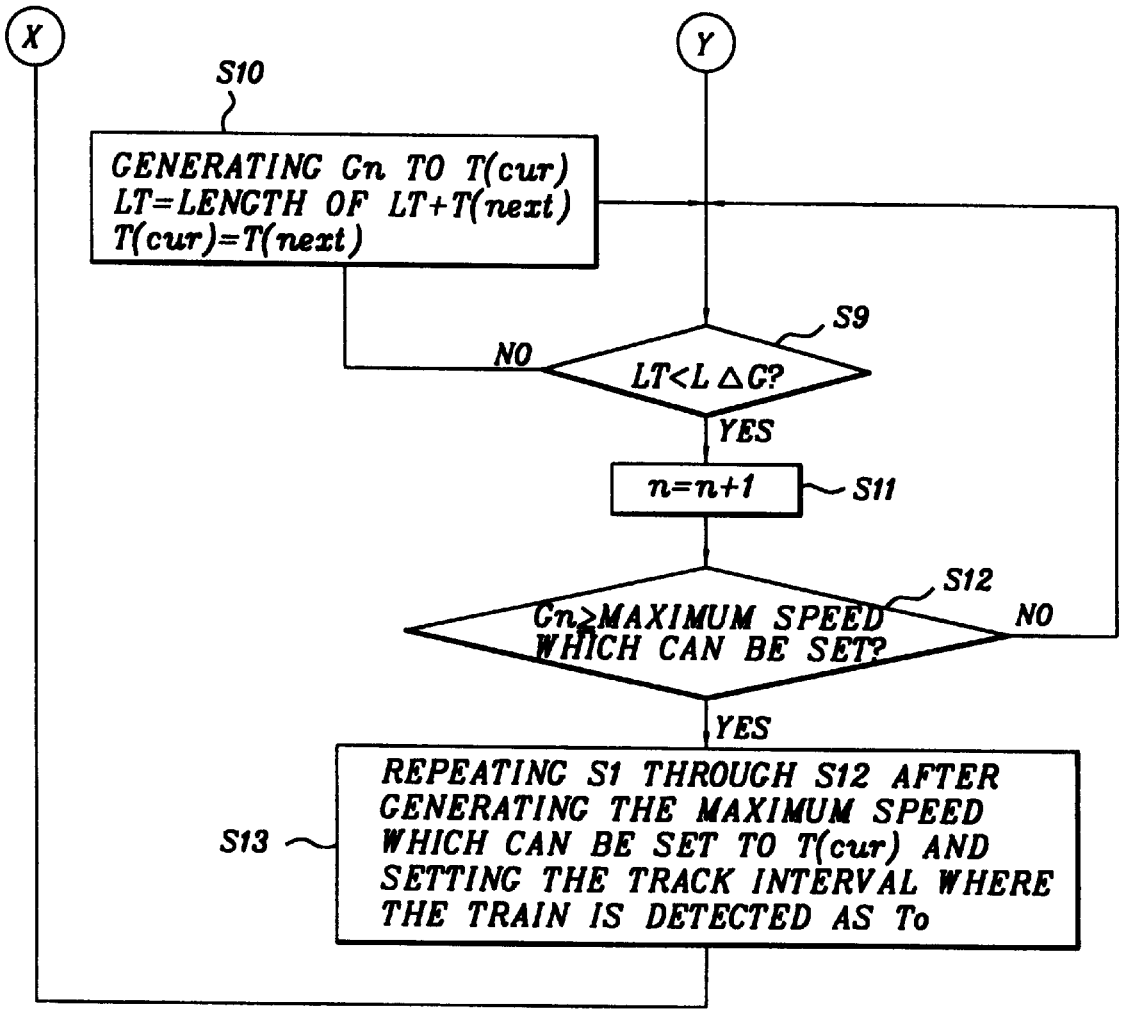

The process of generating a speed indication code for adjusting the speed of the train will now be explained in more detail with reference to FIG. 4.

In step S1, the train is detected at the track interval T0 at the time t1, and in step S2, it is judged as to whether the train is detected at the track interval T.

When the train is detected at the track interval T, then in step S3, the detection time difference Δt between the detection time t2 at the track interval T and the detection time at the track interval T0 is obtained, and in step S4, the speed of the train (V: V=the length of T0/Δt) at the track interval T is obtained. The speed indication code Gn is applied to the track interval T.

In step S5, the track interval T0 is set as the current track interval Tcur, and a speed indication code R is generated at the current track interval T(cur) so as to secure the safety distance, and the length of the current track interval T(cur) is set as the sum length LT of the track interval.

In step S6, it is judged whether the sum length LT is longer than the safety distance. When the sum length LT is shorter than the safety distance, the speed indication code R which is the stop signal is generated at the current track interval T(cur) in step S7. In addition, the sum length LT and the length of the track interval T(next) which is next to the track interval T(cur) are added, and the sum length LT is updated, and the track interval T(next) is set as the current track interval Tcur.

When the sum length LT is judged longer than the safety distance in step S6, the speed indication code Gn of the preceding train is generated at the current track interval T(cur) in step S8, and the speed indication code Gn+1 is changed to the speed indication code Gn. Therefore, the distance LΔG, which is required for the deceleration, is set, and the length of the current track interval T(cur) is set as the sum length LT.

In step S9, it is judged whether the sum length LT is longer than the distance LΔG. If as a result of the judgement, the sum length LT is shorter than the distance LΔG, the speed indication code Gn is generated at the current track interval T(next) in step S10, and the sum length LT and the length of the next track interval T(next) are added, and the sum length LT is updated, and the next track interval T(next) is set as the current track interval T(cur).

When the sum length LT is longer than the distance LΔG, the speed indication code Gn+1 is set as the speed indication code Gn by increasing the number n (where n denotes 1, 2, 3, . . . , n) by 1 in step S11.

In step S12, it is judged whether the speed in accordance with the speed indication code Gn set in step S11 is the maximum speed. If as a result of the judgement, the speed is not the maximum speed, step S9 is performed.

If it is judged in step S12 that the speed in accordance with the speed indication code Gn is the maximum speed in the step S12, the maximum speed is generated at the current track interval T(cur) as a code in step S13, and the track interval at which the train is detected is recognized as the track interval T0, and the steps S1 through S12 are repeated.

As described above, the method for generating a speed control code for a train according to the present invention is directed to enhancing the train transportation efficiency by detecting at the same time the speed of the preceding train and the distance between the preceding train and the next succeeding train, generating the speed indication code corresponding to the speed of the preceding train with respect to the next succeeding train which is in operation at the track interval outside a safety distance which is defined for preventing an accident between the trains, running the train at a constant speed, and evenly distributing the load of the train operation.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. A method for generating a speed control code for a train, comprising the steps of:

a first step for detecting a speed and a position of a preceding train and of a next succeeding train;

a second step for generating a speed indication code for each of plural intervening track intervals so that the next succeeding train can stop within a predetermined safety distance when an interval between the position of the preceding train detected in the first step and the position of the next succeeding train is within the previously set safety distance; and a third step for generating a speed indication code corresponding to the speed of the preceding train when the interval between the position of the preceding train detected in the first step and the position of the next succeeding train is longer than the previously set safety distance.

2. The method of claim 1, wherein in said first step the most recent speed of the preceding train is detected.

3. The method of claim 1, wherein in said second and third steps a speed indication code is generated in accordance with a previously stored length of a track interval which is an acceleration of the next succeeding train.

4. A method for generating a speed control code for a train, comprising the steps of:

a first step for detecting a speed of a preceding train and for generating a speed indication code for a track interval in which the preceding train runs;

a second step for generating a speed indication code of a stop signal to a current track interval which is next to the track interval within which the preceding train runs and for setting a length of the current track interval as a track sum length;

a third step for extending the track sum length when the track sum length is shorter than a safety distance and for setting a necessary distance so as to slow the speed of a next succeeding train down to a speed corresponding to the speed indication code when the track sum length is longer than the previously set safety distance; and a fourth step for prolonging the track sum length when the track sum distance is shorter than the necessary distance in the third step and for returning to the first step after applying a speed indication code corresponding to a maximum speed to the current track interval when the track sum length is longer than the necessary distance set in the third step.

5. The method of claim 4, wherein in said third step a speed indication code corresponding to a stop signal is generated to the current track interval when the track sum length is shorter than the previously set safety distance, the track sum length is prolonged by adding the track sum length and a length of track interval which is next to the current track interval, and the length of track interval which is next to the current track interval is set as the current track interval.

6. The method of claim 4, wherein in said fourth step a predetermined speed indication code is generated to the current track interval when the track sum distance is shorter than the necessary distance set in the third step, the track sum length is prolonged by adding the track sum length and a track interval length which is next to the current track interval, and the track interval length which is next to the current track interval is set as the current track interval.

7. The method of claim 1, further comprising the steps of:

generating a speed indication code of a stop signal to a current track interval which is next to a track interval in which the preceding train runs and for setting a length of the current track interval as a track sum length;

extending the track sum length when the track sum length is shorter than a safety distance and for setting a necessary distance so as to slow the speed of the next succeeding train down to a speed corresponding to the speed indication code when the track sum length is longer than the previously set safety distance; and prolonging the track sum length when the track sum distance is shorter than the necessary distance and for returning to the generating step after applying a speed indication code corresponding to a maximum speed to the current track interval when the track sum length is longer than the necessary distance.

* * * * *